US010297235B2

(12) United States Patent
Rognlien et al.

(10) Patent No.: US 10,297,235 B2
(45) Date of Patent: May 21, 2019

(54) MUSICAL INSTRUMENT STRING WINDER

(71) Applicants: Rand Rognlien, Sonoma, CA (US); Pieter Schouten, Berkley, CA (US)

(72) Inventors: Rand Rognlien, Sonoma, CA (US); Pieter Schouten, Berkley, CA (US)

(73) Assignee: Music Nomad, LLC, Sonoma, CA (US)

( * ) Notice: Subject to any disclaimer, the term of this patent is extended or adjusted under 35 U.S.C. 154(b) by 0 days.

(21) Appl. No.: 15/658,839

(22) Filed: Jul. 25, 2017

(65) Prior Publication Data

US 2018/0025706 A1 Jan. 25, 2018

Related U.S. Application Data

(60) Provisional application No. 62/366,196, filed on Jul. 25, 2016.

(51) Int. Cl.
*G10D 3/00* (2006.01)

(52) U.S. Cl.
CPC ..... *G10D 3/006* (2013.01)

(58) Field of Classification Search
CPC ..... G10D 3/006
USPC ..... 84/458
See application file for complete search history.

(56) References Cited

U.S. PATENT DOCUMENTS 762,723 A * 6/1904 Hutchins ..... G10D 3/14 84/304
2,812,682 A * 11/1957 Longone ..... G10D 3/006 16/426
3,431,807 A * 3/1969 Thompson ..... G10D 3/14 84/304
3,706,254 A * 12/1972 Morin ..... G10D 3/006 84/297 R
3,813,983 A * 6/1974 Paul ..... G10D 3/006 81/469
4,278,002 A * 7/1981 Siminoff ..... G10D 3/006 74/547
5,272,953 A * 12/1993 Koch ..... G10D 3/006 84/304
5,505,116 A * 4/1996 Pantoja ..... G10D 3/006 84/458
6,255,575 B1 * 7/2001 Pearse ..... G10D 3/10 84/312 R
6,294,719 B1 * 9/2001 Palecki ..... G10D 3/006 81/124.2
6,545,206 B2 * 4/2003 Brady ..... G10D 3/00 84/458
7,534,946 B1 * 5/2009 Oxenhandler ..... G10D 3/006 84/298
8,710,340 B2 * 4/2014 Barron ..... G10D 3/006 84/312 R
8,927,838 B2 * 1/2015 Jalgha ..... G10D 3/006 84/304
9,305,526 B1 * 4/2016 Kim ..... G10D 3/006
9,390,691 B2 * 7/2016 Curran ..... G10D 3/006
(Continued)

*Primary Examiner* — David S Warren
*Assistant Examiner* — Christina M Schreiber
(74) *Attorney, Agent, or Firm* — George R. McGuire; Bone Schoeneck & King, PLLC

(57) ABSTRACT

A musical instrument peg winder that includes a tuning peg engaging head, a handle that extends parallel to and laterally offset from the head, and a coupling unit that interconnects the head to the handle.

11 Claims, 8 Drawing Sheets

(56) References Cited

U.S. PATENT DOCUMENTS

| | | | | |
|---|---|---|---|---|
| 2006/0027075 | A1* | 2/2006 | Hirayama | G10D 3/006 84/455 |
| 2006/0130343 | A1* | 6/2006 | Simcoe | B23D 29/023 30/175 |
| 2007/0193430 | A1* | 8/2007 | Jang | G10D 3/006 84/313 |
| 2011/0017047 | A1* | 1/2011 | Barron | G10D 3/006 84/458 |
| 2015/0262560 | A1* | 9/2015 | Curran | G10D 3/006 84/458 |
| 2018/0025706 | A1* | 1/2018 | Rognlien | G10D 3/006 84/458 |

* cited by examiner

MUSICAL INSTRUMENT STRING WINDER

REFERENCE TO RELATED APPLICATION

The present application relates and claims priority to Applicant's U.S. Provisional Application, Ser. No. 62/366,196, filed Jul. 25, 2016, the entirety of which is hereby incorporated by reference.

BACKGROUND

1. Field of Invention

The present invention relates generally to tools used to wind the strings of musical instruments and more particularly to such a tool that engages the peg to which a string is attached for purposes of winding the peg.

2. Background of Art

Removing and replacing a string on a guitar, banjo, violin, or other stringed instrument typically requires the turning of a tuning peg to which the string is attached. When removing the string, the peg must be repeatedly turned until the string becomes detached from the peg, and when replacing the string, the peg must be repeated turned to tighten the string on the instrument to its desired tightness which also determines the tuning of the string. Such repetitious turning of strings is difficult for even a person of good dexterity, but truly difficult and cumbersome for anyone with less dexterity or ability to manipulate the small pegs.

3. Objects and Advantages

It is therefore an object of the present invention to provide a tool with an elongated handle that can be used to engage and turn a peg to which a string is attached.

It is another object of the present invention to provide a tool with a handle that is laterally offset from the axis of the peg engaging head to make it easier to turn the handle.

It is a further object of the present invention to provide a peg engaging head that includes multiple slots for engaging pegs of different widths.

Other objects and advantages of the present invention will in part be obvious and in part appear hereinafter.

SUMMARY OF THE INVENTION

In accordance with the foregoing objects and advantages the present invention provides in one embodiment a musical instrument string winder generally comprising a peg engaging head coupled to a handle that extends along an axis parallel to and laterally offset from the axis in which the head extends. Turning of the handle about the axis in which the head extends causes the head to turn about its axis. Thus, when the head is engaged with a peg, turning of the handle will result in the peg being turned. By offsetting the axis along which the handle extends, the handle can be rotated around a circumference with a radius equal to the length of the handle's offset from the head.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
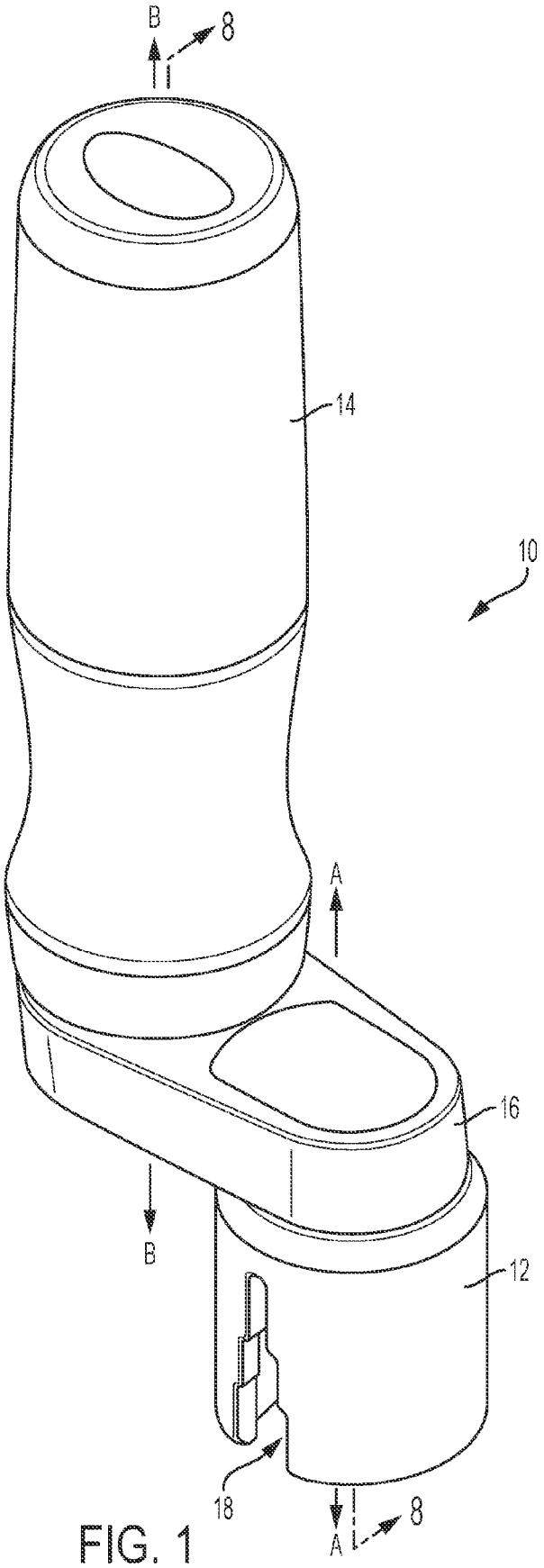
FIG. 1 is a perspective view of an embodiment of the present invention.
Figure 2:
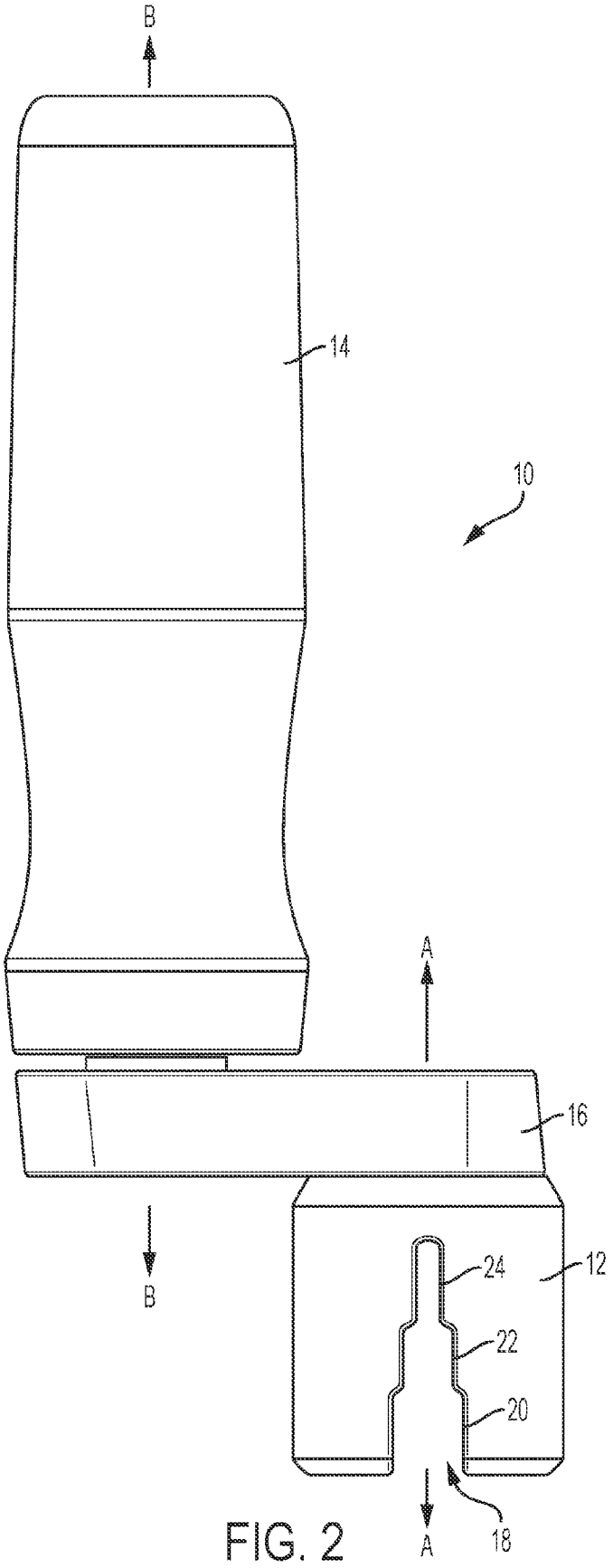
FIG. 2 is a front elevation view thereof.
Figure 3:
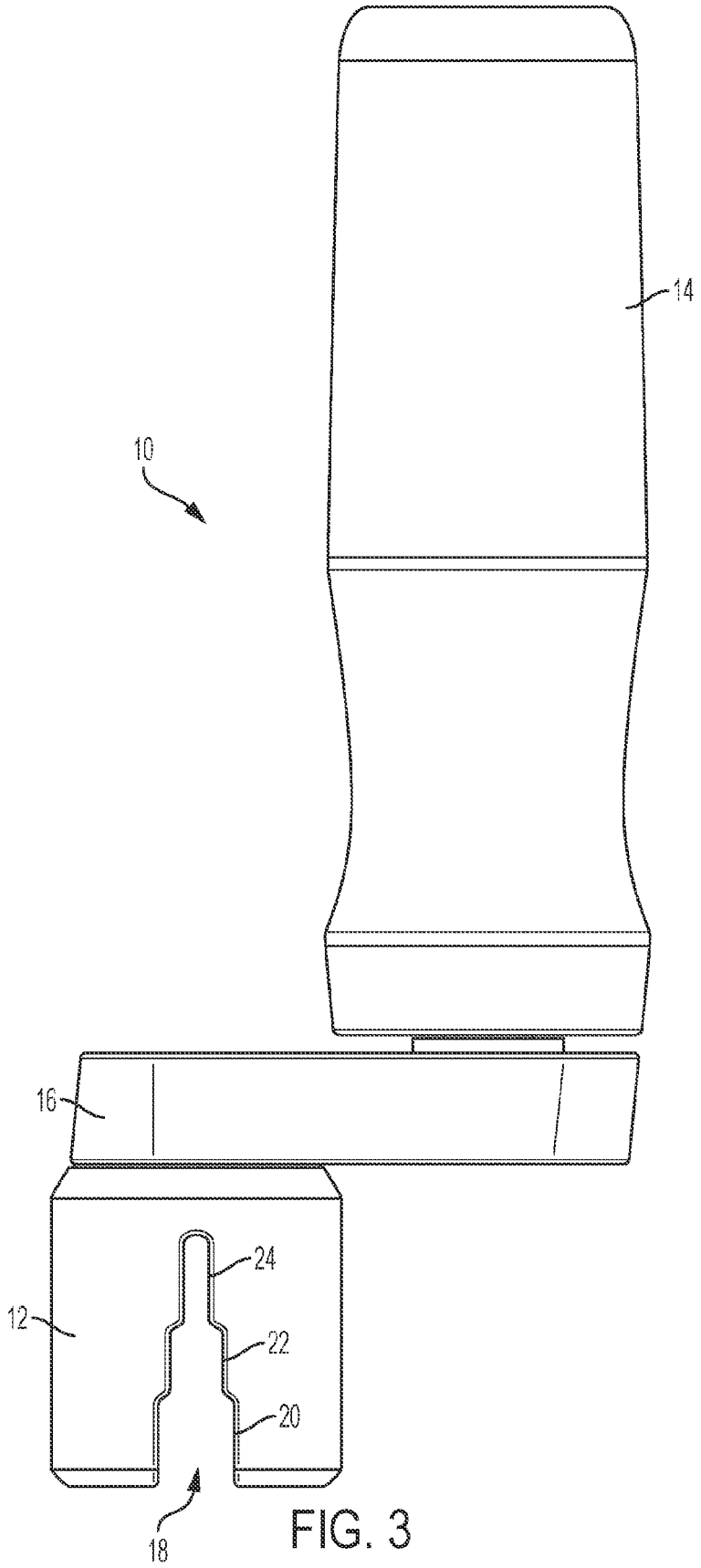
FIG. 3 is a rear elevation view thereof.
Figure 4:
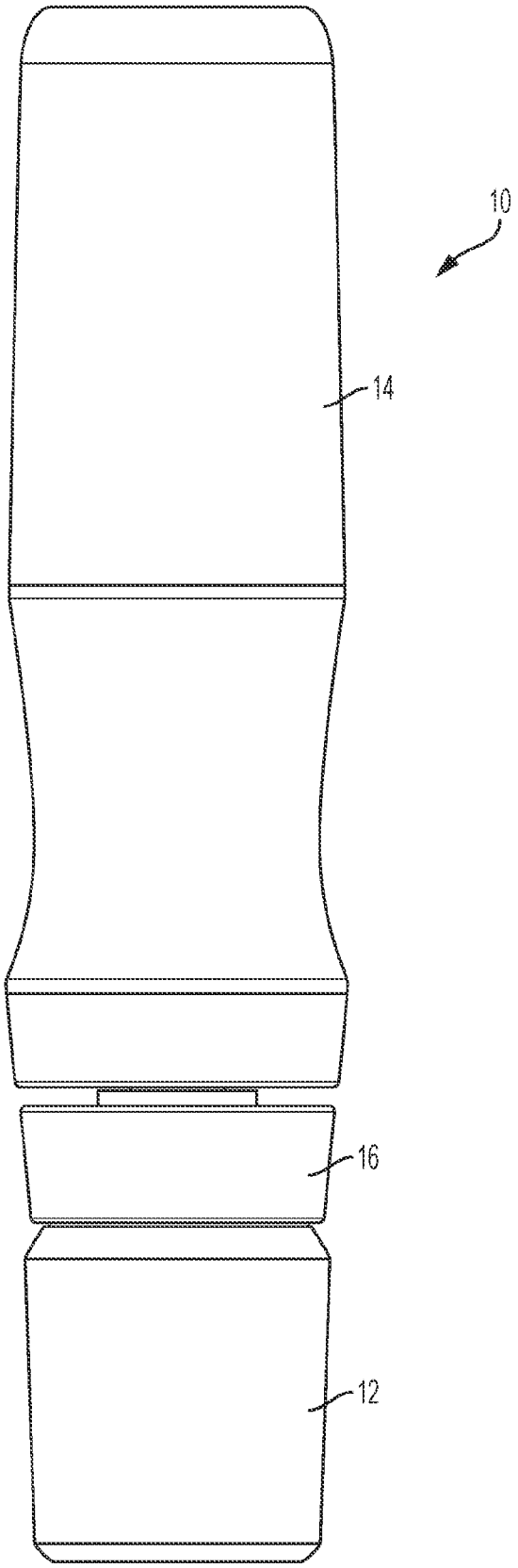
FIG. 4 is a side elevation view thereof.
Figure 5:
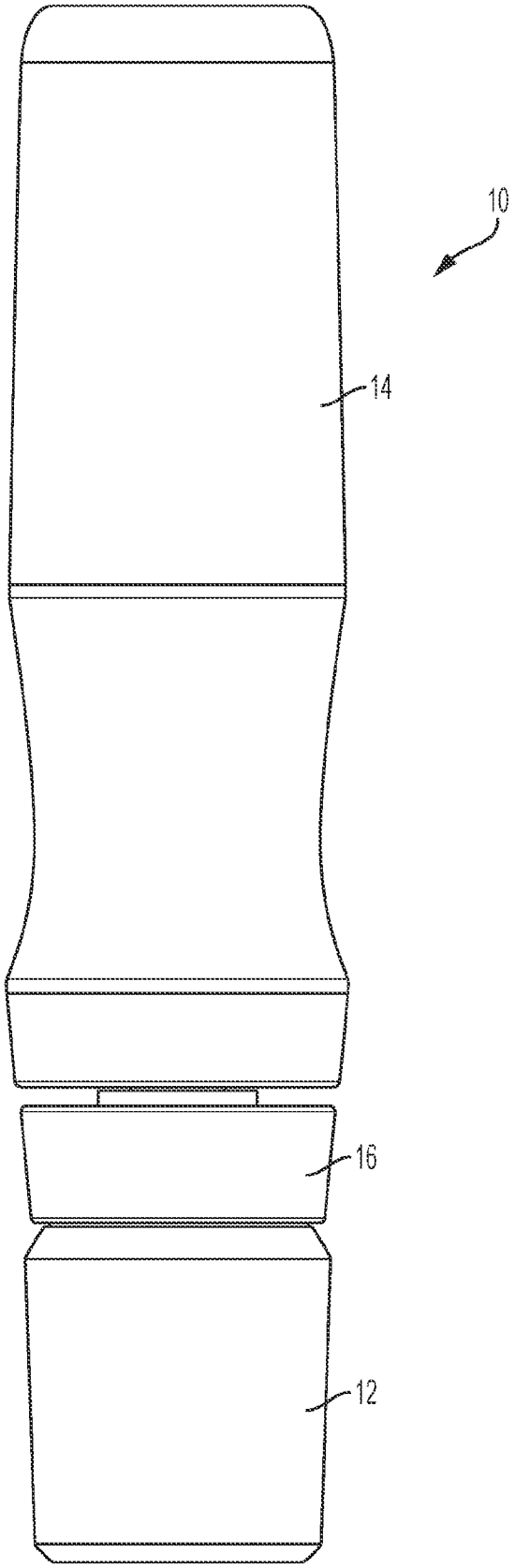
FIG. 5 is a side elevation view thereof.

Referring now to the drawings, in which like reference numerals refer to like parts throughout, there is seen in FIG. 1 a musical instrument string winder designated generally by reference numeral 10. String winder 10 provides a tool to assist in turning a peg to which a string, such as a guitar string for example, is attached, thereby winding or unwinding the string relative to the instrument.

String winder 10 generally comprises a peg engaging head 12 that extends along a longitudinal axis A-A, a handle 14 that extends along a longitudinal axis B-B that is parallel to and laterally offset from axis A-A, and a coupling unit 16 that rigidly interconnects head 12 to handle 14. A user can engage a tuning peg with head 12, grip handle 14 and rotate it around axis A-A to correspondingly turn head 12 about axis A-A, thereby also rotating the tuning peg with which the head 12 is engaged.

Head 12 includes a slot 18 formed centrally therein. Slot 18 includes several steps 20, 22, and 24 of varying widths. The largest of the widths, step 20, is proximate to the exterior/distal end of head 12, with notches 22 and 24 continuing to decrease in width as the slot extends to the interior of head 12. The variously sized slots provide winder 10 with the ability to engage tuning pegs of different sizes. A hex head bit or other non-rotational fastener 26 extends through the proximal end of head 12 and fixedly connects the head to coupling unit 16.

Figure 8:
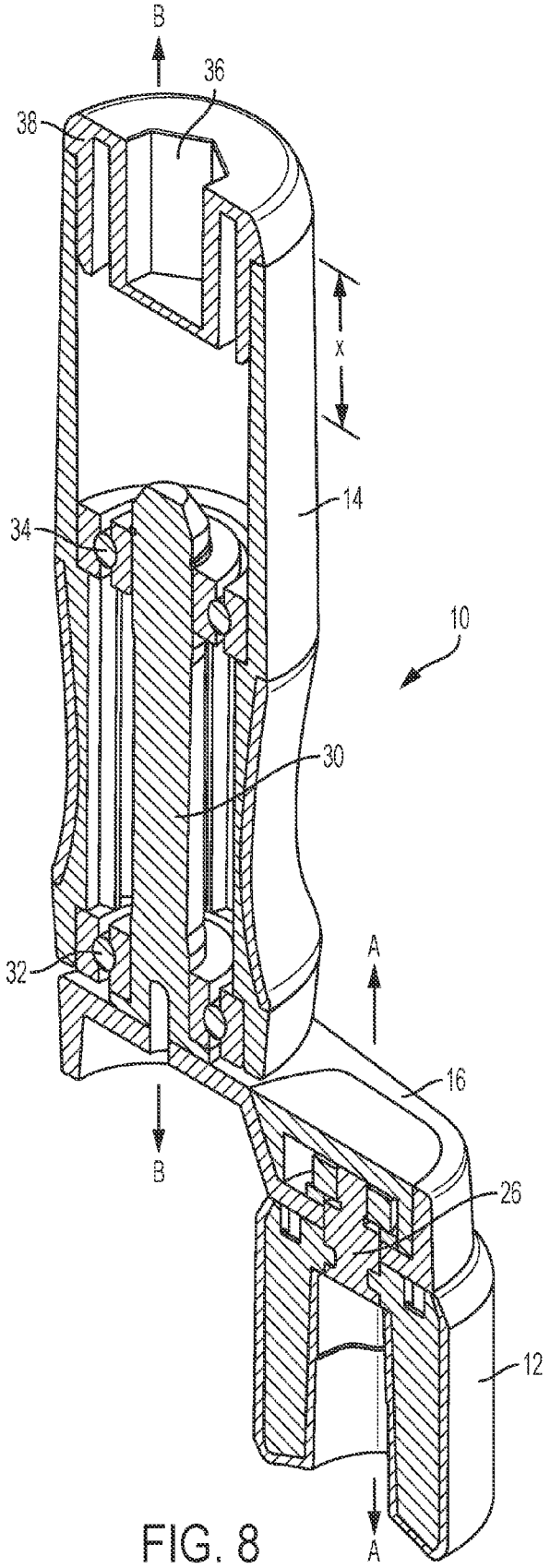
FIG. 8 is a longitudinal cross-sectional view of the embodiment of FIG. 6.

As seen in FIG. 8, a post 30 extends upwardly from coupling unit 16 along axis B-B and handle 14 is positioned over post 30 to interconnect the handle to the coupling unit. Post 30 passes through a pair of bearing units 32, 34 that permit handle 14 to rotate about axis B-B (i.e., permit handle 14 to rotate relative to coupling unit 16). Thus, while a user is rotating handle 14 around axis A-A to turn the tuning pegs, to minimize friction on the user's hand, the handle itself can also rotate about axis B-B.

Figure 6:
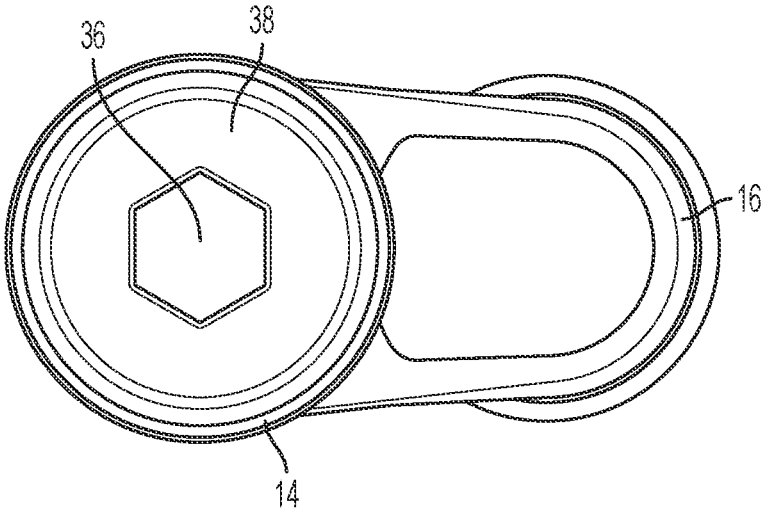
FIG. 6 is a top plan view of an alternate embodiment thereof.
Figure 7:
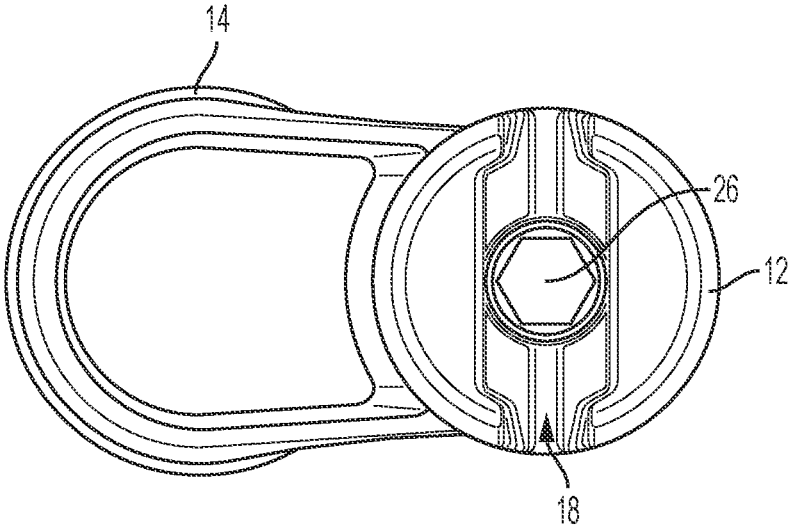
FIG. 7 is a bottom plan elevation view thereof.
Figure 9:
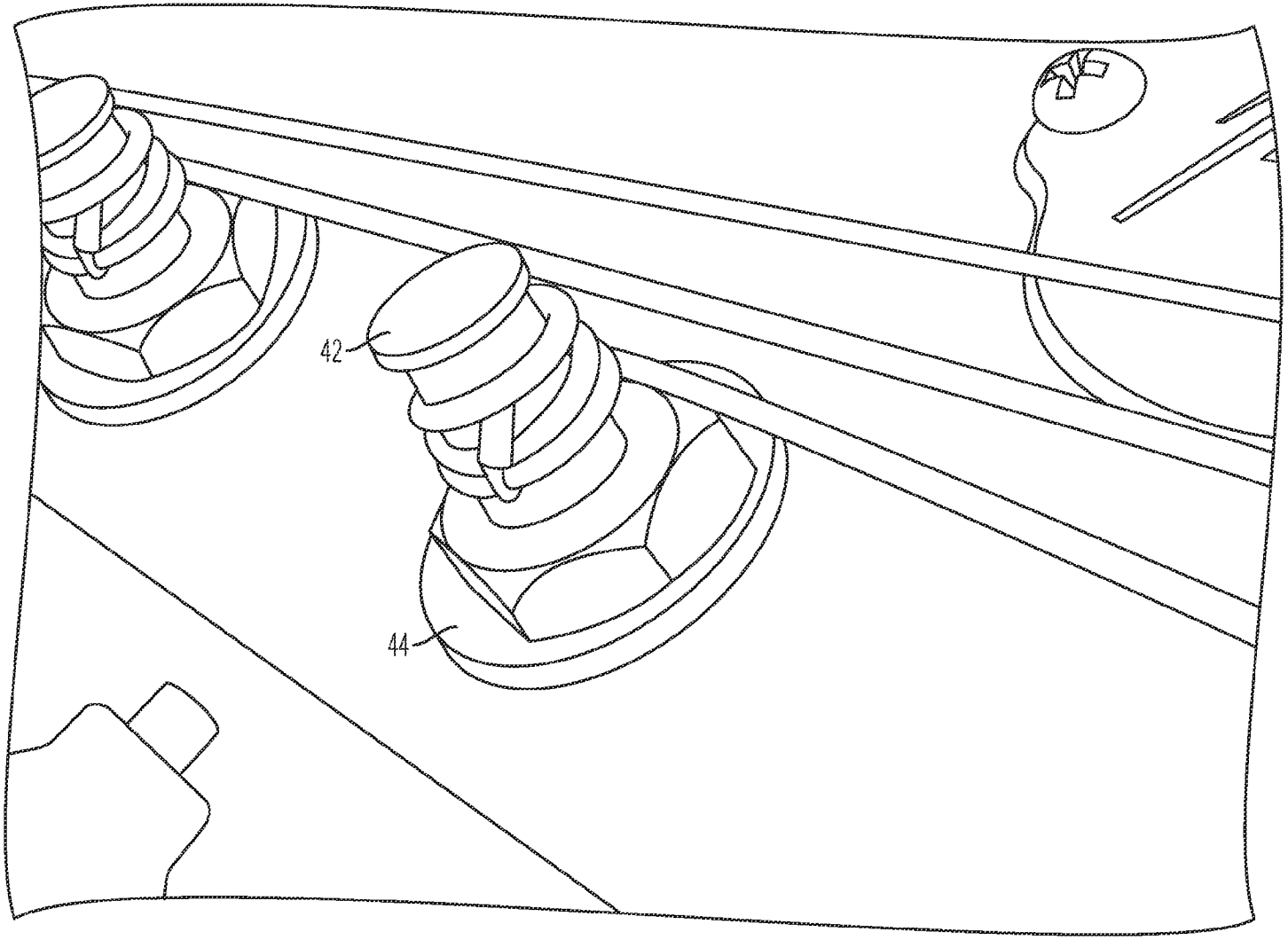
FIG. 9 is a partial perspective view of a tuning machine.

As seen in the cross-section of FIG. 8 and FIGS. 1 and 6, a hex socket 36 is formed in end cap 38 of handle 14. Hex socket 36 will be recessed into end cap 38 by a predetermined distance X, at least 6 mm (although it could be a continuous hex opening), and is used for tightening tuning machines once strings have been removed (see posts 42 in FIG. 9). The predetermined depth to which socket 36 is recessed is sufficient to go over the string post 42 and engage the flat nut 44 at the base.

What is claimed is:

1. A musical instrument peg winder, the musical instrument having a string post, comprising:

a. a peg engaging head that extends along a first longitudinal axis;

b. a handle that extends along a second longitudinal axis that is parallel to and laterally offset from said first longitudinal axis, and comprising an end cap positioned at the end of said handle and having a socket formed therein, wherein said socket is shaped to engage with and effect tightening of the string posts of the musical instrument a bearing assembly, wherein said handle is rotatable about said second longitudinal axis and movable in a circular path about said first longitudinal axis; and c. a coupling unit that couples said peg engaging head to said handle.

2. The musical instrument peg winder of claim 1, wherein said socket is recessed into said end cap by a predetermined depth.

3. The musical instrument peg winder of claim 2, wherein said predetermined depth is at least 6 mm.

4. The musical instrument peg winder of claim 1, wherein said bearing assembly comprises first and second bearing units positioned within said handle in spaced relation to one another.

5. The musical instrument peg winder of claim 1, wherein said peg engaging head comprises a slot having a plurality of steps of varying widths formed therein.

6. A musical instrument peg winder, the musical instrument having a string post, comprising:

a. a peg engaging head that extends along a first longitudinal axis;

b. a handle that extends along a second longitudinal axis that is parallel to and laterally offset from said first longitudinal axis, and comprising a bearing assembly, wherein said handle is rotatable about said second longitudinal axis and movable in a circular path about said first longitudinal axis;

c. a coupling unit that couples said peg engaging head to said handle; and d. a socket attached to said handle, wherein said socket is shaped to engage with and effect tightening of the string posts of the musical instrument.

7. The musical instrument peg winder according to claim 6, further comprising an end cap attached to said handle.

8. The musical instrument peg winder according to claim 7, wherein said socket is formed in said end cap to a predetermined depth.

9. The musical instrument peg winder according to claim 8, wherein said predetermined depth is 6 mm.

10. The musical instrument peg winder of claim 6, wherein said bearing assembly comprises first and second bearing units positioned within said handle in spaced relation to one another.

11. The musical instrument peg winder of claim 6, wherein said peg engaging head comprises a slot having a plurality of steps of varying widths formed therein.

* * * * *